US007298239B2

(12) United States Patent
Yamada

(10) Patent No.: US 7,298,239 B2
(45) Date of Patent: Nov. 20, 2007

(54) THERMAL PROTECTOR

(75) Inventor: Takuya Yamada, Nishikasugai-gun (JP)

(73) Assignee: Ubukata Industries Co., Ltd., Nagoya Aichi (JP)

( * ) Notice: Subject to any disclaimer, the term of this patent is extended or adjusted under 35 U.S.C. 154(b) by 249 days.

(21) Appl. No.: 10/513,341

(22) PCT Filed: Mar. 31, 2003

(86) PCT No.: PCT/JP03/04137

§ 371 (c)(1),
(2), (4) Date: Jun. 20, 2005

(87) PCT Pub. No.: WO03/096367

PCT Pub. Date: Nov. 20, 2003

(65) Prior Publication Data

US 2005/0264393 A1 Dec. 1, 2005

(30) Foreign Application Priority Data

May 7, 2002 (JP) ..... 2002-131419

(51) Int. Cl.
*H01H 37/14* (2006.01)
*H01H 37/52* (2006.01)

(52) U.S. Cl. ..... 337/107; 337/102; 337/101; 337/112

(58) Field of Classification Search ..... 337/101, 337/102, 107, 112
See application file for complete search history.

(56) References Cited

U.S. PATENT DOCUMENTS 2,543,040 A 2/1951 Mertler
3,871,939 A * 3/1975 Woods ..... 156/293
3,902,149 A * 8/1975 Senor ..... 337/110
4,041,432 A * 8/1977 Yarworth et al. ..... 337/111
4,114,127 A * 9/1978 Pejouhy ..... 337/97
4,136,323 A * 1/1979 D'Entremont et al. ..... 337/107
4,167,721 A * 9/1979 Senor et al. ..... 337/112

(Continued)

FOREIGN PATENT DOCUMENTS

JP 01-105435 4/1989

(Continued)

OTHER PUBLICATIONS

Supplemental European Search Report corresponding to EP Application No. EP 03 71 5682 dated Jun. 28, 2007.

*Primary Examiner*—Anatoly Vortman
(74) *Attorney, Agent, or Firm*—Smith, Gambrell & Russell LLP

(57) ABSTRACT

A thermal protector (1) including two fixed contacts (13A, 13B) provided at the end part of conduction terminal pins (5A, 5B) projecting into a metallic enclosed container (100), a support (6) arranged in a case, an oscillatory heating resistor (8) supported by the support and having two movable contacts (9A, 9B) facing the fixed contacts, and a heat responsive body (10) interposed between the heating resistor and the support and coupled with the heating resistor through a coupler (12). When an overcurrent flows through the heating resistor to generate heat therefrom and the temperature of the heat responsive body reaches a set level, the heat responsive body is inverted. Inverting motion of the heat responsive body is transmitted to the heating resistor through the coupler, and the current path is opened.

6 Claims, 8 Drawing Sheets

U.S. PATENT DOCUMENTS 4,224,591 A * 9/1980 Senor ..... 337/102
4,231,010 A * 10/1980 Cardin ..... 337/94
4,287,499 A * 9/1981 Pejouhy ..... 337/97
4,376,926 A * 3/1983 Senor ..... 337/104
4,399,423 A * 8/1983 Nield ..... 337/102
4,476,452 A * 10/1984 D'Entremont ..... 337/102
4,555,686 A * 11/1985 Pejouhy et al. ..... 337/102
4,843,363 A * 6/1989 Ubukata et al. ..... 337/94
4,866,408 A * 9/1989 Petraitis et al. ..... 337/104
5,107,241 A * 4/1992 Ubukata et al. ..... 337/368
5,212,465 A * 5/1993 Mizutani et al. ..... 337/368
5,721,525 A * 2/1998 Hofsass ..... 337/102
5,757,261 A * 5/1998 Becher et al. ..... 337/377
5,973,587 A * 10/1999 Hofsass ..... 337/377
6,249,211 B1 * 6/2001 Hofsaess ..... 337/377
6,674,620 B2 * 1/2004 Lamborghini et al. ..... 361/26

FOREIGN PATENT DOCUMENTS

JP 02139820 A * 5/1990
JP 10-021808 1/1998
JP 2001-229795 8/2001
WO PCT/JP03/04137 11/2003
WO WO03/096367 A1 11/2003

* cited by examiner

THERMAL PROTECTOR

TECHNICAL FIELD

This invention relates to a thermal protector suitable for protecting, against burnout, electric motors used in enclosed electric compressors, particularly, three-phase motors.

BACKGROUND ART

Conventional thermal protectors include a protector having three pairs of contacts as disclosed in JP-B-46-34532 and a protector having two pairs of contacts as disclosed in JP-A-1-105435 and JP-A-10-21808.

The number of movable and fixed contacts is six in the thermal protector with the three pairs of contacts, which number is non-economical. Further, the three movable contacts are secured to a metal plate serving as a heating resistor, and the metal plate is supported in its central portion by a thermally responsive plate. The central portion of the metal plate is pressed such that the three movable contacts are uniformly pressed, whereupon a stable contacting is achieved. However, the metal plate fixed by caulking or the like in a through hole provided in the central portion of the thermally responsive plate drawn into the shape of a dish. In short, the metal plate is supported on the central portion of the thermally responsive plate, on which portion stress concentrates. Accordingly, stress applied to the thermally responsive plate differs depending upon a degree at which the metal plate is caulked relative to the thermally responsive plate, whereupon the characteristic of the thermal protector tends to easily change. That is, there arises a problem that it becomes difficult to stabilize the performance of the thermal protector.

On the other hand, a movable contact is secured to the thermally responsive plate itself in the thermal protector having the two pairs of contacts. Electric current is caused to flow through the thermally responsive plate so that its heat generation reverse the thermally responsive plate to open the contacts. This type of thermal protector is called direct heat type. Since the thermally responsive plate is heated up by the electric current in the thermal protector of the direct heat type, a response speed of the thermally responsive plate to an overcurrent is advantageously increased.

However, since a part which generates heat is limited to the thermally responsive plate, the peripheral components is difficult to heat up. Accordingly, when the thermal protector operates such that a current path is cut off, heat generated by the thermally responsive plate is absorbed by the peripheral components whose temperatures are relatively lower, whereupon a contact opening time cannot be rendered longer. As a result, the temperature of a motor winding having been increased by the overcurrent cannot be reduced sufficiently during cutoff of current such that a temperature reached by the motor winding is inevitably rendered higher while the thermal protector repeats its reverse and return. In this case, there is a problem that the increased temperature reduces the insulating performance of an insulating coating of the motor winding thereby to cause a short circuit which leads to possible burn-out.

Further, when a bimetal or trimetal each with a suitable curvature and operating temperature is selected as a material for the thermally responsive plate, the specific resistance of the thermally responsive plate does not always take a suitable value. That is, there is a problem that it is difficult to design a thermal protector having both suitable values of operating current and operating temperature.

The applicant invented a thermal protector which overcame the foregoing problems and filed a patent application for the invention in Japan (laid open under JP-A-2000-229795). This thermal protector is of an indirect heat type in which a thermally responsive plate is reversed by heat generation of a heating resistor. In this protector, the temperature of the thermally responsive plate is increased by heat radiation from the heating resistor when the current increases the temperature of the heating resistor. When an overcurrent or the like excessively increases the temperature of the heating resistor such that the thermally responsive plate reaches a set operating temperature, the thermally responsive plate quickly reverses thereby to cut off the current path. Not only the temperature of the thermally responsive plate but also the temperatures of peripheral components are increased by the heating resistor in the thermal protector of the indirect heat type. Accordingly, since heat is difficult to be absorbed from the thermally responsive plate to the periphery, it takes more time for the temperature of the thermally responsive plate to decrease. As a result, it takes more time for the temperature of the thermally responsive plate to decrease, whereupon the contact opening period of time can be rendered longer. Thus, since the temperature of the motor winding is sufficiently decreased during the contact opening period of time, the winding can reliably be protected against burnout. Further, the design of the thermally responsive plate can easily be carried out since the thermally responsive plate can be designed only in consideration of the reversing temperature.

However, when a protector is arranged which has a large operating current exceeding 200 A, there arises a defect that a large current also flows through components on the current path other than the heating resistor. For example, a large current also flows through an elastic member supporting the heating resistor in the above-mentioned thermal protector. As a result, the elastic member itself is heated more or less. When the elastic member is repeatedly heated for a long period of time, the elastic member looses its elasticity, whereupon the contacts cannot be opened. As a countermeasure for this problem, a thickness of the elastic member is increased so that a resistance value thereof is decreased thereby to reduce an amount of heat generated. However, the thickness of the elastic member cannot be increased over the value allowing elastic deformation. This results in an upper limit of the operating current of the thermal protector, whereby a thermal protector having a large operating current cannot be arranged.

Therefore, an object of the present invention is to provide a thermal protector which can be coped with a large operating current in the arrangement that the thermally responsive plate is revered in response to the heating of the heating resistor thereby to cut off the current path.

DISCLOSURE OF THE INVENTION

The present invention provides a thermal protector which includes a thermally responsive plate reversing when reaching a set temperature and returning when decreased below the set temperature, thereby making and breaking an electric current path, the thermal protector characterized by a casing including a housing made from a metal and having an opening, a metal plate closing the opening and having two through holes and two electrically conductive terminal pins inserted through the respective holes of the metal plate with an insulating filling member interposed therebetween, two fixed contacts fixed to ends of the conductive pins protruding into an interior of the casing respectively, a support including a main portion, a leg provided on the main portion and a support hole provided in the leg, the leg being secured to the metal plate so that the support is disposed in the casing, a heating resistor disposed between the metal plate and the main portion of the support so as to be substantially in parallel to the metal plate, the heating resistor having an end with a protrusion inserted into the support hole, the heating resistor swung about the protrusion so as to come close to and depart away from the metal plate, two movable contacts fixed to a portion of the heating resistor opposed to the fixed contacts, a coupler provided on the other end of the heating resistor for transmitting reversion and return of the thermally responsive plate to the heating resistor, and an electrically conductor electrically connecting the support and the heating resistor, and characterized in that the thermally responsive plate is disposed between the heating resistor and the main portion of the support so as to be substantially in parallel to the heating resistor, the thermally responsive plate having one of two ends fixed to the support and the other end coupled via the coupler to the heating resistor.

In the above-described construction, the movable contacts are normally in contact with the fixed contacts such that two current paths are formed through the heating resistor between the metal plate and each conductive terminal pin, and further, the thermally responsive plate reverses when an overcurrent causes the thermally responsive plate to heat up and the temperature of the thermally responsive plate is increased to each a set temperature. A reversing operation of the thermally responsive plate is transferred through the coupler to the heating resistor. As a result, the heating resistor is swung such that the movable contacts are departed away from the respective fixed contacts, whereupon the current paths are cut off. With cut off of the current path, the temperature of the heating resistor is decreased such that the temperature of the thermally responsive plate is decreased to or below the set temperature, the thermally responsive plate returns. Then, the heating resistor is swung to return to its former state, whereupon the movable contacts are brought into contact with the fixed contacts respectively so that the current paths are made.

In the foregoing construction, the reversing and returning operations of the thermally responsive plate are transferred through the coupler to the heating resistor. Furthermore, the elastic member used for supporting the thermally responsive plate and heating resistor are excluded from the components of the current paths. Accordingly, since the number of components generating heat upon subjection to an overcurrent is reduced other than the heating resistor, the operating current can be set to a large value. In the foregoing construction, particularly, when an electric conductor with a sufficiently small electric resistance is used, an amount of heat generated by the conductor can be restrained to a small value, whereupon the foregoing construction is further effective.

BEST MODE FOR CARRYING OUT THE INVENTION

The present invention will be described with reference to the accompanying drawings for more detailed description.

Figure 1:
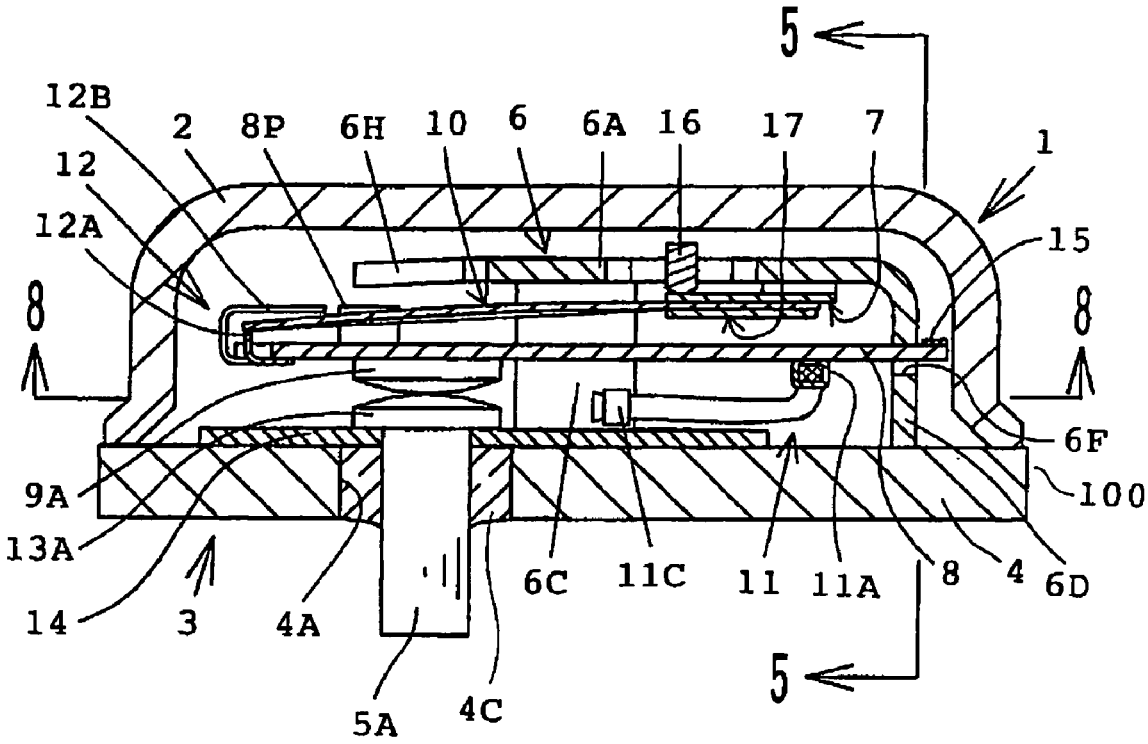
FIG. 1 is a longitudinal section of a three-phase internal protector as a thermal protector in accordance with a first embodiment of the present invention.
Figure 2:
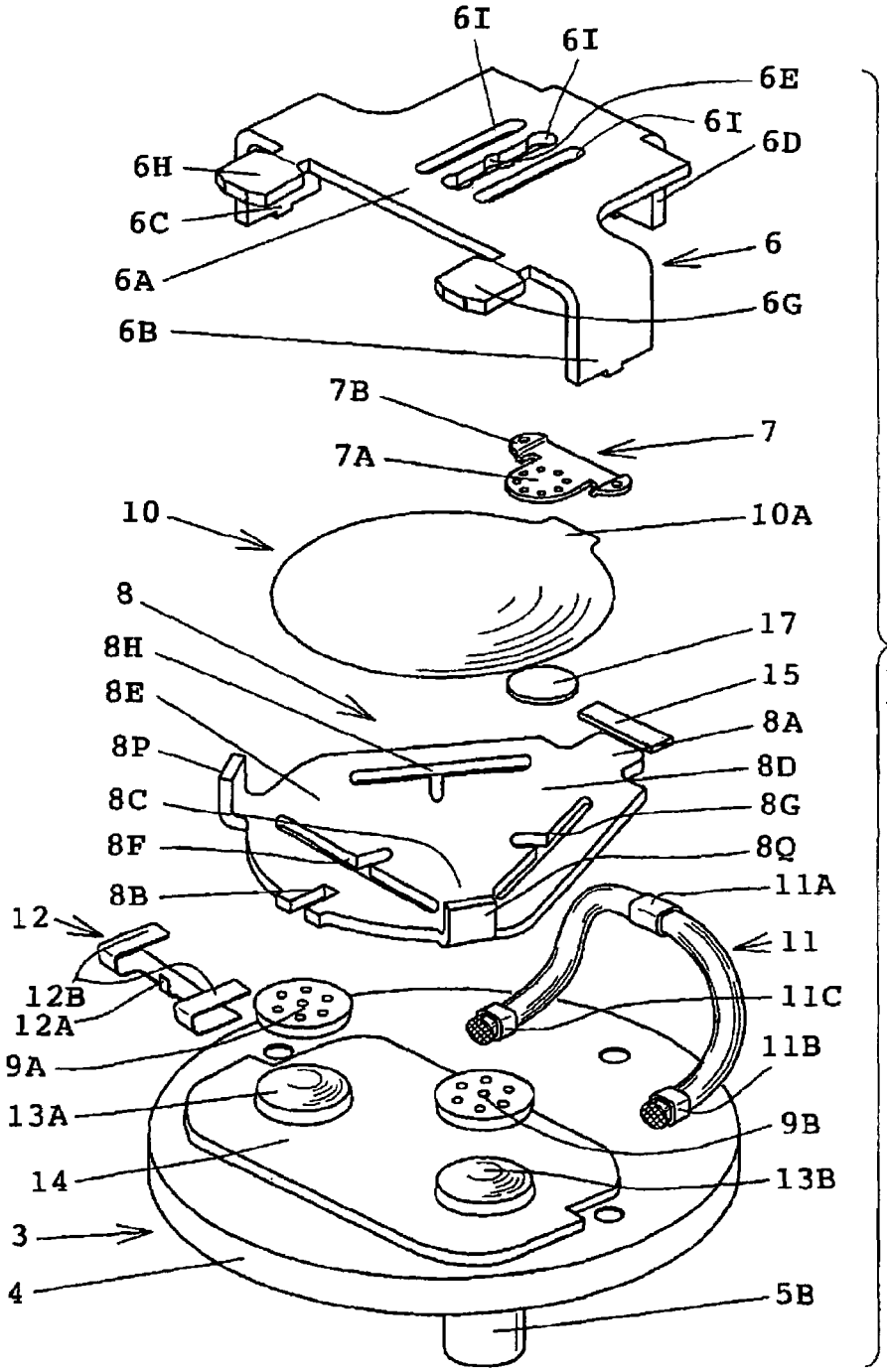
FIG. 2 is an exploded perspective view of the internal protector, showing the inner construction thereof.
Figure 3:
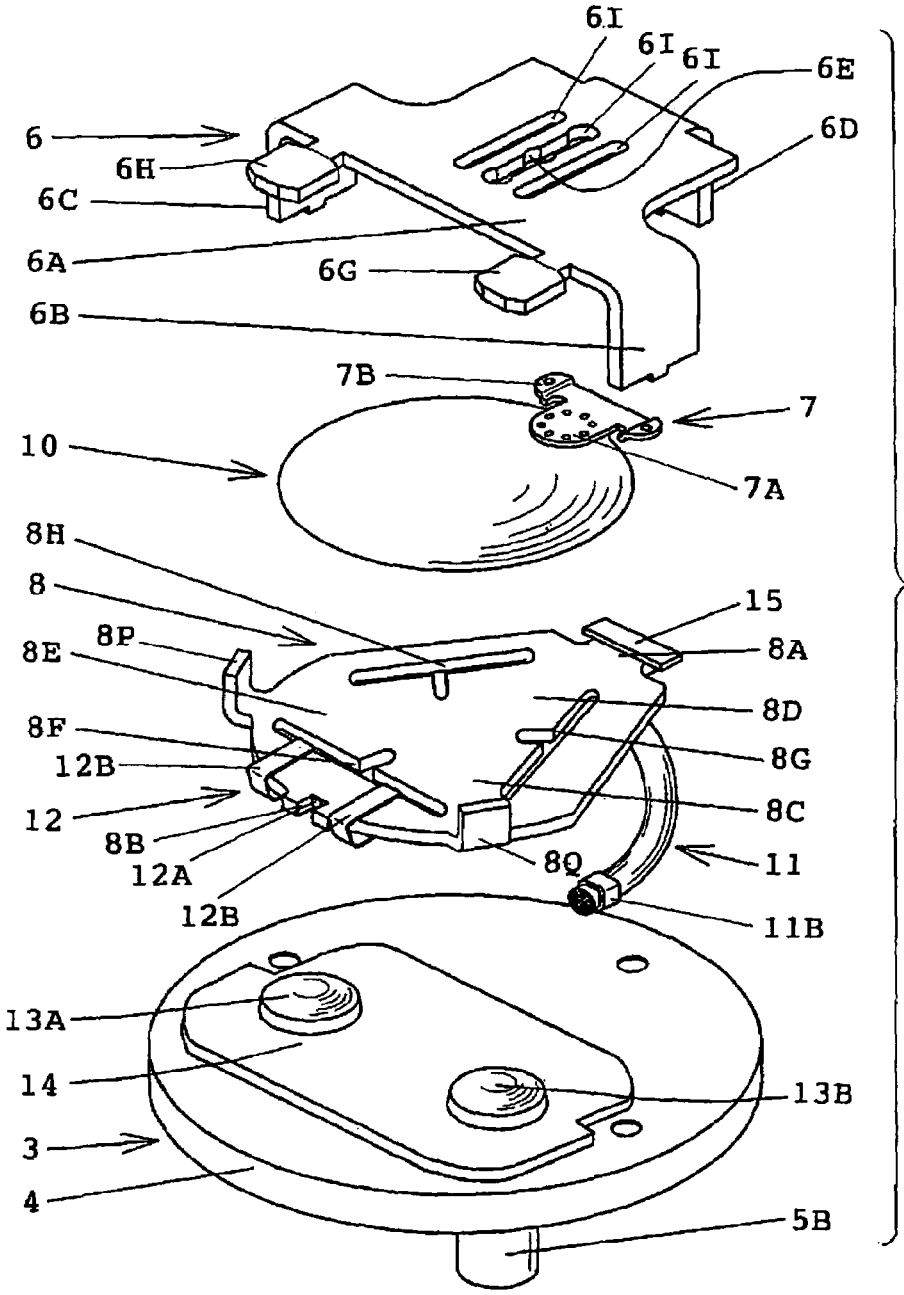
FIG. 3 is an exploded view showing the inner construction of the internal protector with part of the components being eliminated.
Figure 4:
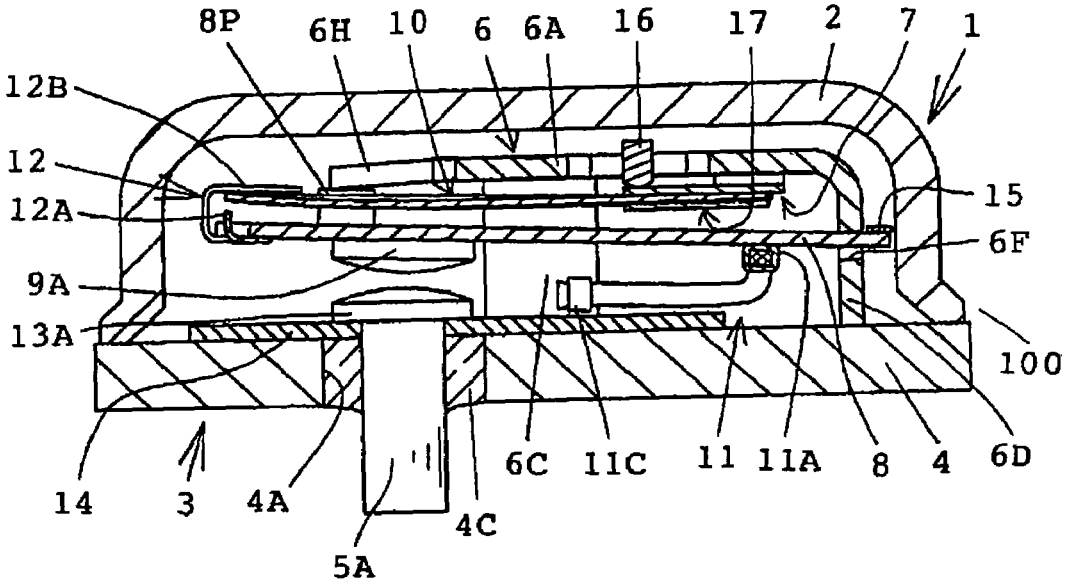
FIG. 4 is a longitudinal section of the internal protector in its operation.
Figure 5:
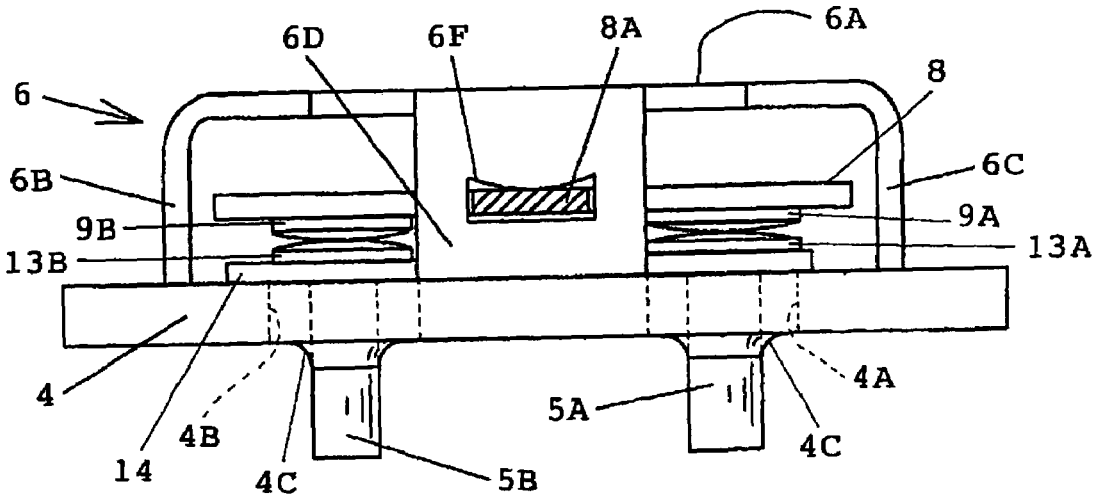
FIG. 5 is a view explaining the operation of the heating resistor in the closed state of the contacts and a longitudinal section taken along line 5-5 in FIG. 1 with a part of the heating resistor being eliminated.
Figure 6:
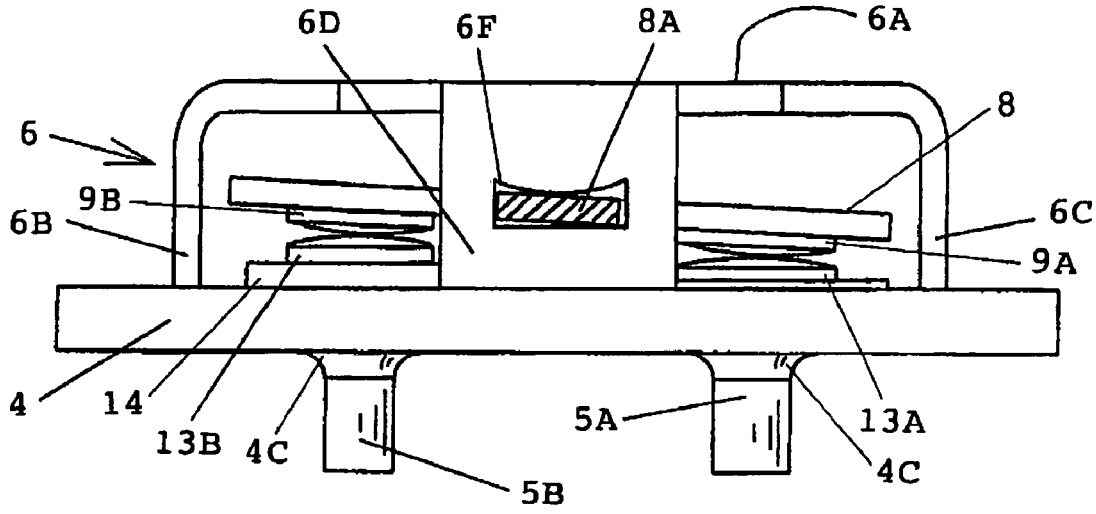
FIG. 6 is a view similar to FIG. 5, showing the state where the heating resistor is slightly inclined.
Figure 7:
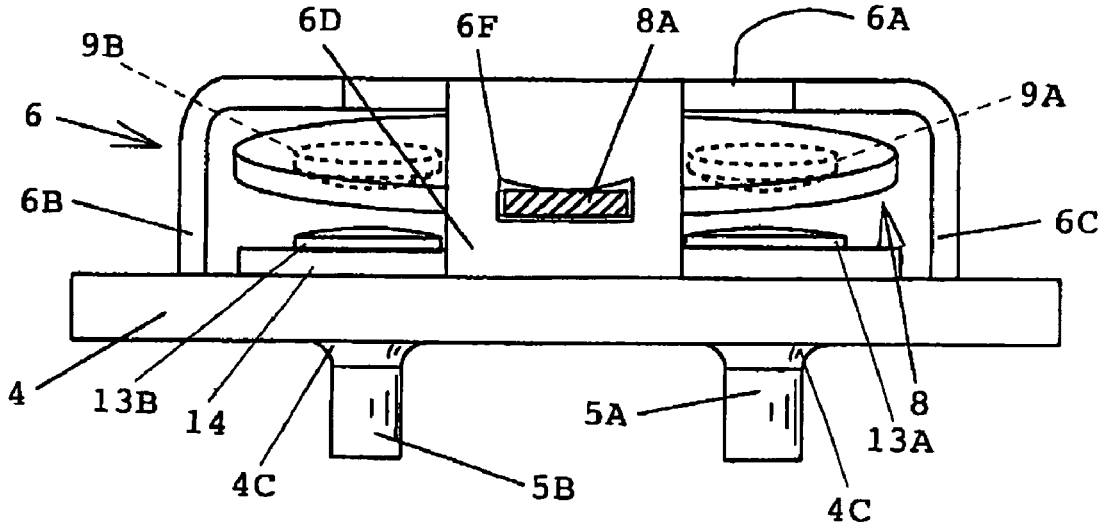
FIG. 7 is a view similar to FIG. 5, showing the state where the contacts are open.
Figure 8:
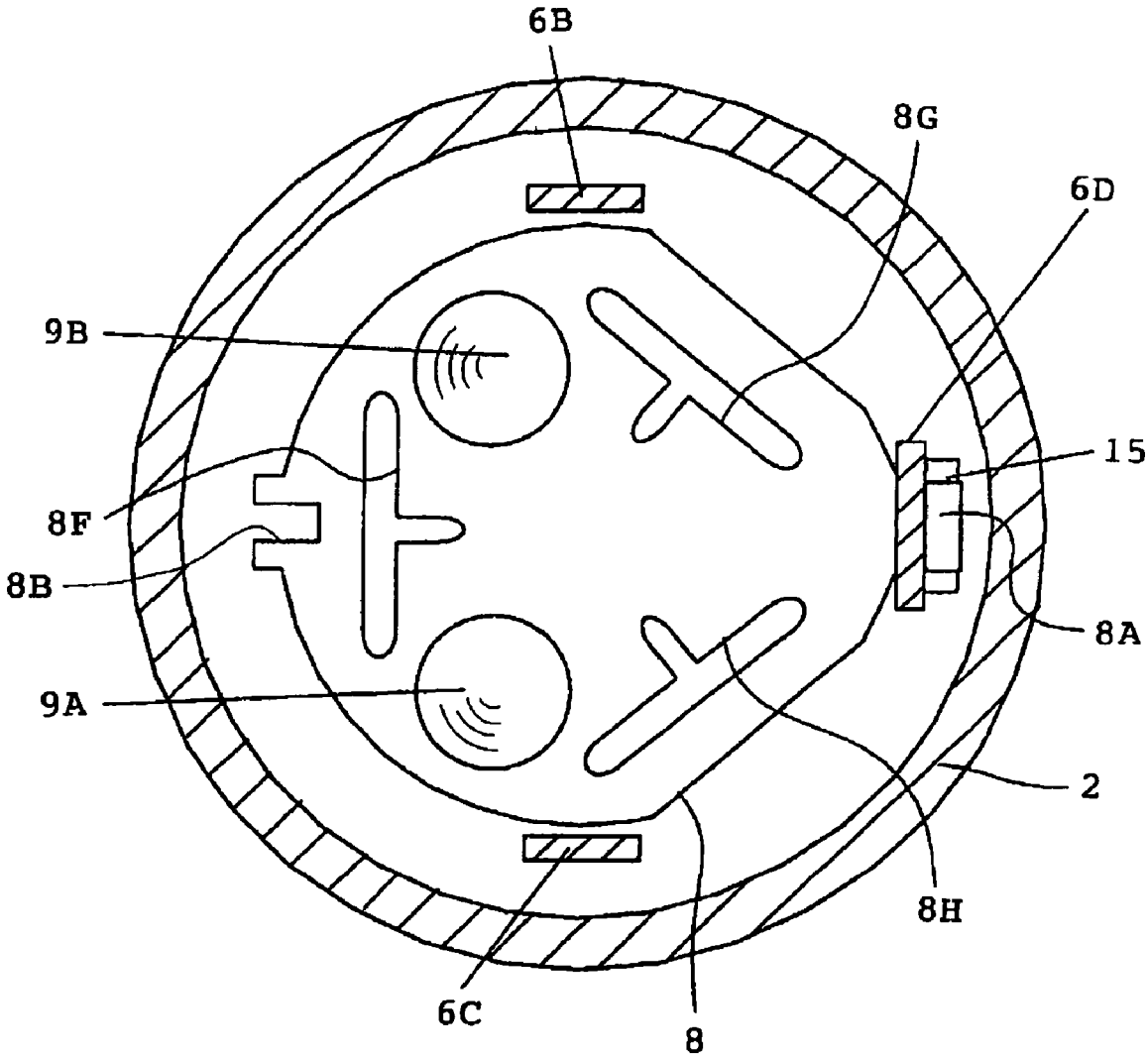
FIG. 8 a cross section taken along line 8-8 in FIG. 1.

Firstly, a first embodiment of the invention will be described with reference to FIGS. 1 to 8. FIG. 1 is a longitudinal section of a three-phase internal protector as a thermal protector in accordance with the embodiment of the present invention. FIGS. 2 and 3 are exploded perspective views of the internal protector, showing components of the internal protector. FIG. 4 is a longitudinal section of the internal protector in its operation. FIGS. 5 to 7 are side views of the internal protector with a housing and the heating resistor being eliminated in order that the movement of the heating resistor may be explained. FIG. 8 a cross section taken along line 8-8 in FIG. 1.

As shown in FIG. 1, the internal protector 1 in accordance with the embodiment has a hermetic container 100 (corresponding to a casing) including a circular dome housing 2 made of a metal and a header plate 3 secured to an open end of the housing 2 by ring projection welding or the like.

The header plate 3 comprises a circular metal plate 4 having two through holes 4A and 4B (see FIG. 5). Electrically conductive terminal pins 5A and 5B are inserted through the holes 4A and 4B respectively and are insulated from and hermetically fixed to the header plate 4 by an electrically insulating filler 4C. A ceramic plate 14 is attached to the upper surface of the metal plate 4 to protect the filler 4 against contact arc. Fixed contacts 13A and 13B each made from a silver alloy are secured by welding or the like to the upper end surfaces of the terminal pins 5A and 5B exposed on the upper surface of the ceramic plate 14 respectively.

A support 6 is provided in the hermetic container 100. As shown in FIG. 2, the support 6 has a main surface 6A serving as a main portion, three legs 6B, 6C and 6D extending downward from a peripheral portion of the main surface 6A, and arm-shaped portions 6G and 6H provided on one side of the main surface 6A. The main surface 6A is provided with three slits 6I. The central slit 6I is formed with a screw-inserting portion 6E. A screw 16 is inserted through the screw-inserting portion 6E. Lower ends of the legs 6B, 6C and 6D secured to the metal plate 4 by spot welding. The main surface 6A is parallel with the metal plate 4.

A substantially circular thermally responsive plate 10 is supported on the lower portion of the support 6 as shown in FIGS. 1, 2 and 4. The thermally responsive plate 10 is supported while one end thereof is held between a central portion 7A of a connecting piece 7 and a presser plate 17. An end 7B of the connecting piece 7 is secured to the underside of the main surface 6A by the projection welding or the like so that the thermally responsive plate 10 is supported by the support 6. In this case, the lower end of the screw 16 is in abutment with the central portion 7A of the connecting piece 7. The presser plate 17 disperses stress at the secured portion of the thermally responsive plate 10 thereby to prevent the thermally responsive plate 10 from cracking, so that the presser plate has an effect of improving the durability of the thermally responsive plate 10. The thermally responsive plate 10 is made by drawing a bimetal or trimetal into the shape of a shallow dish and reverses and returns quickly at predetermined temperatures.

A substantially circular heating resistor 8 is assembled between the thermally responsive plate 10 and the header plate 3, as shown in FIGS. 1 to 3. The heating resistor 8 is made from a resisting material such as an iron-chromium alloy and has a heating portion whose area is substantially equal to an area of the thermally responsive plate 10. A protruding piece 8A is provided on a right-hand end of the heating resistor 8 as viewed in FIG. 2. A notch 8B is provided in a portion of the heating resistor 8 opposed to the protruding piece 8A. A pair of curved protrusions 8P and 8Q are provided on portions of the heating protrusion 8 symmetric about the notch 88.

Movable contacts 9A and 9B are secured to the undersides of portions 8C and 8E of the heating resistor 8 opposed to the fixed contacts 13A and 13B respectively. Further, a central part of a conductor 11 is secured to the underside of portion 8D of the heating resistor 8. The conductor 11 has both ends 11B and 11C secured to the legs 6B and 6C of the support 6 respectively. The conductor 11 has a sufficiently low resistance value so as not to heat up and has elasticity so as not to prevent opening and closing operations of the heating resistor 8. The conductor 11 comprises a stranded wire made, for example, by binding a plurality of copper wires. Further, the heating resistor 8 is designed so that resistance values of the portions between 8C-8D, between 8C-8E and between 8D-8E are rendered substantially equal to one another so that amounts of heat generated by these portions become uniform.

Further, T-shaped slits 8F, 8G and 8H are formed in the portions between 8C-8E, between 8C-8D and between 8D-8E of the heating resistor 8 respectively as shown in FIGS. 2, 3 and B. The slits 8F, 8G and 8H are formed in order that electrical paths of the heating resistor 8 may be narrowed to increase resistance values so that a desired amount of heat is obtained. The embodiment exemplifies a protector whose operating current is about 200 A. For example, in the case of the operating current of about 250 A, no slit is necessary since a sufficient amount of heat can be obtained without slit.

It is suggested to reduce the thickness of the heating resistor as a method of increasing the resistance value of the heating resistor. In this method, however, the mechanical strength of the heating resistor is reduced. Accordingly, when the heating and the opening and closing operations of the heating resistor are repeated for a long period of time, the heating resistor is deformed such that the operating current changes. In the embodiment, however, the heating resistor 8 is formed with the T-shaped slits 8F, 8G and 8H in order that the electrical paths thereof may be narrowed so that the resistance value is increased. As a result, the thickness of the heating resistor 8 need not be increased and accordingly, reduction in the mechanical strength can be minimized. Further, since the heating resistor is required to efficiently transfer heat by radiation to the thermally responsive plate, an area of the heating resistor's portion opposed to the thermally responsive plate cannot be decreased to a large degree. In the embodiment, each slit is formed into the T-shape so that the resistance value can be increased while the area of the heating resistor's portion opposed to the thermally responsive plate is limited to a small value.

The leg 6D of the support 6 has a generally rectangular through hole 6F (corresponding to a support hole) formed in generally central portion thereof as shown in FIGS. 1 to 3 and 5. The protruding piece 8A is inserted into the through hole 6F. A fixing piece 15 is secured to the distal end of the protruding piece 8A by welding or the like, whereupon the protruding piece 8A can be prevented from falling off from the hole 6F. A short side of the hole 6F is set so as to have a dimension (the width in FIG. 5) larger than the thickness of the protruding piece 8A. Further, the hole 6F has an upper side which is formed into an arc shape. The notch 8B is formed in the portion of the heating resistor 8 opposed to the protruding piece 8A. A coupler 12 is fixed to the notch 8B. The coupler 12 has a protrusion 12A and two arm-shaped portions 12B. The thermally responsive plate 10 is inserted between the protrusion 12A and the arm-shaped portions 12B. The arm-shaped portions 12B correspond to a first abutting portion in the invention, whereas the protrusion 12A corresponds to a second abutting portion in the invention.

A gap between the protrusion 12A and the arm-shaped portions 12B is larger than the thickness of the thermally responsive plate 10. Thus, the thermally responsive plate 10 is coupled to the heating resistor 8 with a play.

The thermally responsive plate 10 is usually in abutment with the protrusion 12A of the coupler 12 to depress the heating resistor 8 downward as shown in FIG. 1. As a result, contacts are closed. The protrusion 12A is located on the central axis passing the center between the movable contacts 9A and 9B and is in abutment at one portion thereof with the thermally responsive plate 10. Thus, a pressing force of the thermally responsive plate 10 is applied uniformly to the contacts.

On the other hand, as shown in FIG. 4, when reversing, the thermally responsive plate 10 abuts the two arm-shaped portions 12B of the coupler 12, raising the heating resistor 8. As a result, the contacts are opened. The two arm-shaped portions 12B are located symmetrically about the central axis passing the center between the movable contacts 9A and 9B. Accordingly, a reversing force of the thermally responsive plate 10 is applied substantially uniformly to each arm-shaped portion 12B. Accordingly, since the movable contacts 9A and 9B are departed from the respective fixed contacts 13A and 13B without being inclined, the contact openings of the two contact pairs can be prevented from being non-uniform. Further, the curved protrusions 8P and 8Q abut the arm-shaped portions 6G and 6H of the support 6 respectively such that a predetermined contact opening is maintained.

In the embodiment, a force of the screw 16 pressing the thermally responsive plate 10 via the end of the connecting piece 7 is adjusted so that a temperature at which the thermally responsive plate 10 reverses is calibrated. Further, the internal protector 1 is constructed by securing the legs 6B, 6C and 6D of the support 6 to the header plate 3 after components have been attached to the header plate 3 and the support 6 and further by securing the peripheral edge of the header plate 3 to the open end of the housing 2.

The operation of the internal protector 1 will now be described with reference to FIGS. 1, 4, 5, 6 and 7.

The temperature of the thermally responsive plate 10 is not more than an operating temperature when an electric motor to be protected is in normal operation. Accordingly, as shown in FIG. 1, the heating resistor 8 is pressed downward by the pressing force of the thermally responsive plate 10, whereupon the movable contacts 9A and 9B are in contact with the fixed contacts 13A and 13B respectively. In the contact closed state, the internal protector 1 includes current paths between the metal plate 4 and the terminal pins 5A and 8B, that is, current flows from the metal plate 4 through the support 6, conductor 11, heating resistor 8, movable contact 9A (9B) and fixed contact 13A (13B) to the terminal pin 5A (5B). The internal protector 1 further includes a current path between the terminal pins 5A and 5B, that is, current flows from the terminal pin 5A through the fixed contact 13A, movable contact 9A, heating resistor 8, movable contact 9B and fixed contact 13B to the terminal pin 5B.

Further, the heating resistor 8 can be inclined a slight angle since a space is defined around the protruding piece 8A in the through hole 6F. Accordingly, for example, even when there is a difference between the heights of the two fixed contacts 13A and 13B, the pressing force of the movable contacts 9A and 9B applied to the fixed contacts 13A and 13B can be balanced.

Still further, when the contacts are closed, the thermally responsive plate 10 presses the heating resistor 8 downward while the movable contacts 9A and 9B serve as fulcrums and the protrusion 12A of the coupler 12 serves as an emphasis. As a result, the protruding piece 8A of the heating resistor 8 is normally pressed against the upper side of the through hole 6 (see FIG. 5). Further, the upper side of the through hole 6F is formed into an arc shape, so that the protruding piece 8A of the heating resistor 8 is brought into point contact with the upper side of the hole 6F at its central portion. Consequently, the heating resistor 8 tends to be further inclined.

On the other hand, the thermally responsive plate 10 reverse when an amount of heat generated by the heating resistor 8 is increased with the increase in electric current due to an overload operation of the motor or a locked rotor condition, or the thermally responsive plate 10 reaches a predetermined operating temperature by an increase in the temperature of the motor compressor. Then, as shown in FIG. 5, the heating resistor 8 is raised by the thermally responsive plate 10 such that the movable contacts 9A and 9B are departed from the fixed contacts 13A and 13B respectively. As a result, all the above-mentioned current paths are opened.

In the above-described construction, since the protrusion 12A of the coupler 12 is in abutment with the thermally responsive plate 10, a bypass current path is in the current path from the support 6 through the conductor 11 to the heating resistor 8. The bypass current path extends from the support 6 through the thermally responsive plate 10 and the coupler 12 to the heating resistor 8. However, since the protrusion 12A of the coupler 12 is in point contact with the thermally responsive plate 10, a resistance value is rendered larger than the current path through the conductor 11. Accordingly, heating due to the bypass current does not matter. In particular, when the resistance value of the heating resistor 8 needs to be set to a large value, an insulating sheet is inserted between the coupler 12 and the thermally responsive plate 10 at need although a ration of the bypass current is increased. As a result, the bypass current can be eliminated.

Figure 9:
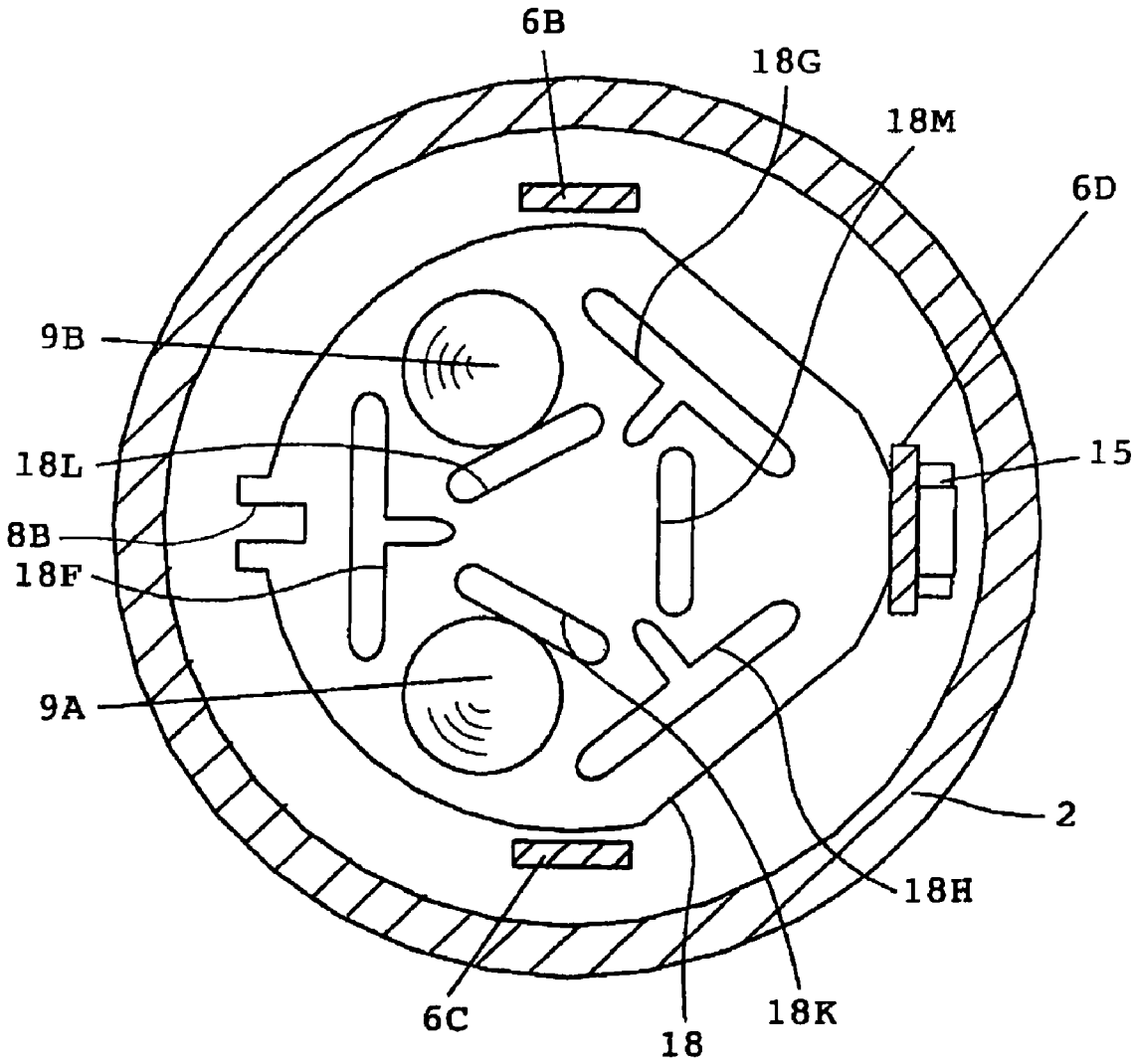
FIG. 9 is a view similar to FIG. 8, showing a second embodiment.

FIG. 9 illustrates a second embodiment of the present invention. Differences of the second embodiment from the first embodiment will be described. FIG. 9 illustrates the construction of the heating resistor 18 in the case where an operating current is set to a small value of about 100 A, for example. The heating resistor 18 is further provided with slits 18K, 18L and 18M in addition to the T-shaped slits 18F, 18G and 18H. The current paths of the heating resistor 18 are further narrowed by the addition of the slits 18K, 18L and 18M, whereupon the resistance value can be increased. As the result of such a construction, the mechanical strength and the area of the heating resistor 18 opposed to the thermally responsive plate 10 can be prevented from being decreased to a large degree while an amount of heat generated by the heating resistor 18 is increased.

Figure 10:
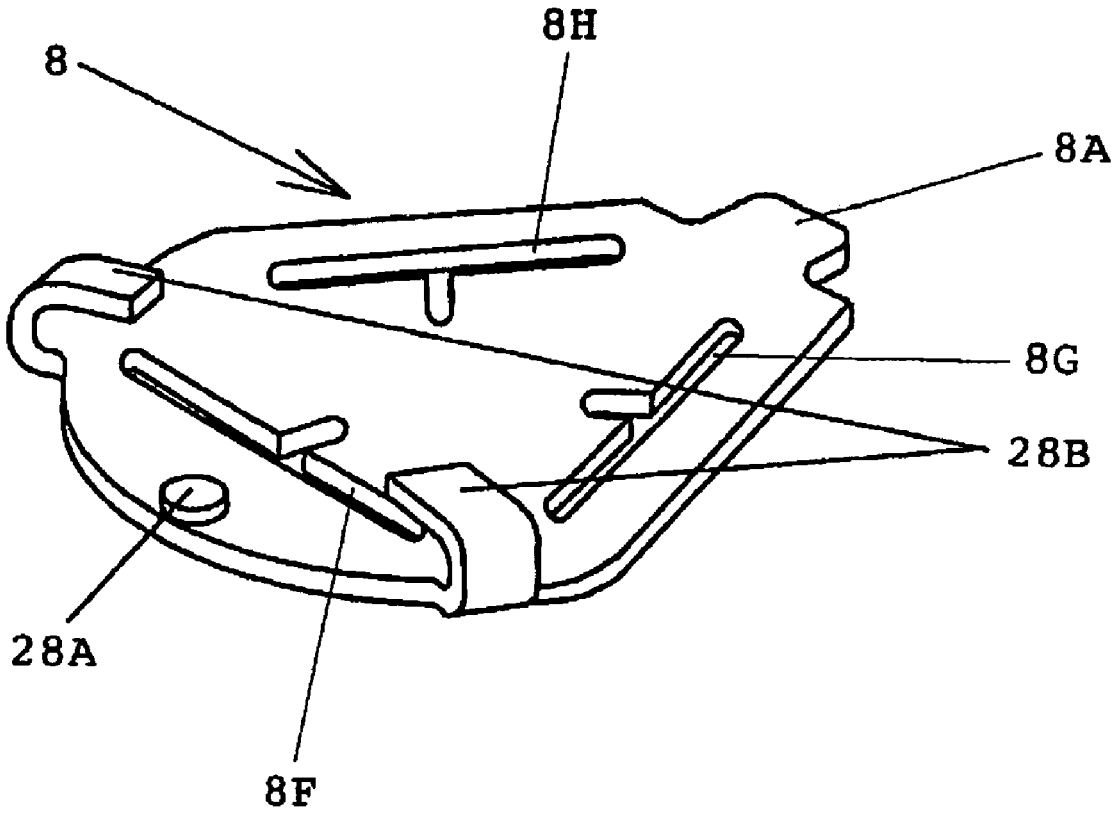
FIG. 10 is a perspective view of the heating resistor in a third embodiment of the present invention.

FIG. 10 illustrates a third embodiment of the present invention. Differences of the third embodiment from the first embodiment will be described. In the third embodiment, the heating resistor 28 is formed integrally with the coupler. More specifically, the coupler comprises an abutting portion 28A provided on the end of the heating resistor 28 (corresponding to the first abutting portion) and a pair of arm-shaped portions 28B (corresponding to the second abutting portion) provided on portions of the heating protrusion 8 symmetric about the abutting portion 28A. The foregoing construction can also achieve the same effect as the first embodiment.

The invention should not be limited to the foregoing embodiments but may be modified as follows.

The coupler 12 can be formed into various shapes without being limited by the shapes of the arm-shaped portion 12B, protrusion 12A and the like as shown in FIG. 2 when the coupler 12 has a structure that it abuts the thermally responsive plate at two portions thereof upon reversion of the thermally responsive plate and at one portion thereof upon return.

Either the first or second abutting portion of the coupler may be formed integrally with the heating resistor and the other may be discrete from the heating resistor.

The conductor 11 should not be limited to the strand of copper wires. For example, thin copper plates may be placed one upon another.

The material and dimensions of the heating resistor may suitably be selected on the basis of an amount of heat generated and rigidity under a high temperature each satisfying the characteristics of the thermal protector.

INDUSTRIAL APPLICABILITY

As obvious from the foregoing, the thermal protector of the present invention may be suitable for a protector protecting a three-phase motors against burnout, in particular, is useful as a protector which can cope with a large operating current.

The invention claimed is:

1. A thermal protector which includes a thermally responsive plate reversing when reaching a set temperature and returning when decreased below the set temperature, thereby making and breaking an electric current path, the thermal protector comprising, a casing including a housing made from a metal and having an opening, a metal plate closing the opening and having two through holes and two electrically conductive terminal pins inserted through the respective holes of the metal plate with an insulating filling member interposed therebetween;

two fixed contacts fixed to ends of the conductive pins protruding into an interior of the casing respectively;

a support including a main portion, a leg provided on the main portion and a support hole provided in the leg, the leg being secured to the metal plate so that the support is disposed in the casing;

a heating resistor disposed between the metal plate and the main portion of the support so as to be substantially in parallel to the metal plate, the heating resistor having an end with a protrusion inserted into the support hole, the heating resistor swung about the protrusion so as to come close to and depart away from the metal plate;

two movable contacts fixed to a portion of the heating resistor opposed to the fixed contacts;

a coupler provided on the other end of the heating resistor for transmitting reversion and return of the thermally responsive plate to the heating resistor, and an electrically conductor electrically connecting the support and the heating resistor, wherein, the thermally responsive plate is disposed between the heating resistor and the main portion of the support so as to be substantially in parallel to the heating resistor, the thermally responsive plate having one of two ends fixed to the support and the other end coupled via the coupler to the heating resistor.

2. A thermal protector according to claim 1, wherein, the thermally responsive plate has an area substantially equal to a heating portion of the heating resistor and includes a central portion drawn so that the thermally responsive plate is formed into a shape of a shallow dish.

3. A thermal protector according to claim 1, characterized in that the support hole of the support is formed into a generally rectangular shape and extends shorter in a direction of a swinging motion of the heating resistor and longer in a direction perpendicular to the direction of a swinging motion of the heating resistor.

4. A thermal protector according to claim 3, characterized in that when the movable contacts are in contact with the respective fixed contacts, the protrusion and a long side of the support hole are in point contact with each other.

5. A thermal protector according to claim 4, characterized in that the long side of the support hole brought into point contact with the protrusion is formed into an arc shape expanded toward an interior of the support hole.

6. A thermal protector according to claim 1, wherein the coupler includes first and second abutting portions, the abutting portion abutting the thermally responsive plate at two portions thereof symmetrical about a center line between the two movable contacts when the thermally responsive plate reverses, the second abutting portion abutting the thermally responsive plate at a portion located on the center line between the two movable contacts when the thermally responsive plate returns.

* * * * *